US005851437A

United States Patent [19]

Brown et al.

[11] Patent Number: 5,851,437

[45] Date of Patent: Dec. 22, 1998

[54] METHOD AND COMPOSITION FOR NEUTRALIZING STATIC ELECTRICITY

[75] Inventors: Bobby J. Brown, Dalton, Ga.; Bruce K. Fillipo, Hatboro, Pa.; David M. Polizzotti, Yardley, Pa.; Gregory J. Pomrink, Horsham, Pa.

[73] Assignee: BetzDearborn Inc., Trevose, Pa.

[21] Appl. No.: 837,744

[22] Filed: Apr. 22, 1997

[51] Int. Cl.[6] ..... H01B 1/00

[52] U.S. Cl. ..... 252/500; 361/212; 95/71

[58] Field of Search ..... 361/212; 252/1, 252/500; 95/71

[56] References Cited

U.S. PATENT DOCUMENTS

| | | | |
|---|---|---|---|
| 3,924,157 | 12/1975 | Peters | 361/225 |
| 3,939,080 | 2/1976 | Martin | 252/1 |
| 3,956,161 | 5/1976 | Woodward | 510/434 |
| 3,970,595 | 7/1976 | Ginn et al. | 510/535 |
| 3,984,731 | 10/1976 | Martin | 317/2 R |
| 4,077,914 | 3/1978 | Peters | 252/518 |
| 4,169,279 | 9/1979 | Friedman, Jr. et al. | 361/212 |
| 4,314,308 | 2/1982 | Faulkner | 361/212 |
| 4,762,638 | 8/1988 | Dollman et al. | 510/254 |

*Primary Examiner*—Jacqueline V. Howard
*Assistant Examiner*—Cephia D. Toomer
*Attorney, Agent, or Firm*—Alexander D. Ricci; Steven D. Boyd

[57] ABSTRACT

Positive static electricity charges in air flow from an air washer generated by an industrial process are reduced and controlled to a desired level by treatment of the water circulating in the air washer with an anionic polymeric material such as water soluble, neutralized polyacrylate.

3 Claims, No Drawings

METHOD AND COMPOSITION FOR NEUTRALIZING STATIC ELECTRICITY

FIELD OF THE INVENTION

The present invention relates to the neutralization of static electricity in air-wash systems. More particularly, the present invention relates to anionic materials which when added to an air-wash system effectively reduce positive static charges.

BACKGROUND OF THE INVENTION

Static electricity arises in many industrial processes from the constant movement of materials and equipment aligning electrons in a specific pattern. The term static electricity (triboelectricity) refers to the accumulation of electric charge by contact or friction between two dissimilar objects when separated. The intensity and sign of the charge formed is dependent upon the composition of the materials and the amount of friction encountered during separation.

In certain industries, the presence of static electricity in a room where certain processes are carried out has a decidedly adverse effect on the quality of the products being produced and the efficacy of the processes being performed. For example, in the textile industry, during processes being performed. For example, in the textile industry, during the processing of fibers into yarn and textile fabrics, static electricity interferes with smooth processing of the fibers. Control of the static electricity charge and intensity under such circumstances enhances the efficacy of the process.

In industries where static electricity can be problematic, for example the textile industry, air conditioning equipment know as air washers is employed to maintain desired conditions. As used herein, air washer refers to spray equipment in which a liquid (typically water) is sprayed into an air flow. Such spray equipment or air washer may, for example, include adiabitic water sprays for evaporative cooling and chilled water sprays for both dehumidification and cooling.

Conventionally, an air washer includes a reservoir or tank in which water is retained, a pump for circulating the water from the reservoir to a spray manifold, sprays through which the water is discharged into an air flow, separator plates for removing drops of liquid from the air flow and returning them to the reservoir, and a makeup supply for maintaining the recirculating body of water at a desired level within the reservoir.

An alternative arrangement, which is also used provides a sump tank in which chilled water is retained and remote air washer stations to which the water is circulated. In such systems, a cooling tower having a sump of from 2,000 to 3,000 gallons may serve a chiller sump of from 40,000 to 50,000 gallons. Such a chiller sump may serve multiple air washers having sumps of from 5,000 to 6,000 gallons.

Such air washer-chiller systems and their use such as in the textile industry are generally well know to persons skilled in the art of air conditioning. As used herein, air washer refers to any such system.

In air washer systems, control of static electricity can enhance the efficacy of the industrial process. For example, in the textile industry, static electricity in the area where fibers are processed into yarn or filament can reduce breakage thereby reducing downtime and enhancing the operation.

U.S. Pat. No. 3,939,080 discloses a composition and method for reducing negative static charges in a manufacturing environment by adding a positively charged quaternary ammonium compound to the water in an air-washer system.

The present inventors have discovered that undesirable positive charges of static electricity can be reduced by incorporating a negatively charged polymeric material into the water of an air-washer system. The addition of the preferred negatively charged polymeric species also results in inhibition of corrosion and scale deposition within the air-washer system. Water soluble, anionic polymeric species are believed to provide the desired charge reduction. Preferred treatments are water soluble, neutralized, polyacrylates having a molecular weight of from about 1,000 to about 5,000. Such materials have been found to effectively reduce positive static electricity charges encountered in air washer systems employed in textile manufacturing processes.

A problematic by-product of machine processing of textiles is short fibers which combine with dust and airborne static charges. The addition of charged polymeric species to the water of an air-washer system in accordance with the present invention minimizes the repulsive forces between like charged air borne particles to inhibit dust cloud formation by promoting settling of the particles. The process of the present invention also inhibits "static-cling" of such particles to machines, walls, air ducts etc.

In grinding operations, such as grinding of metal ores, potentially hazardous dust clouds can be created. The static electricity control additive of the present invention, when used in an air-washer of a grinding operation will inhibit positively charged dust particle clouds by promoting settling of the particles.

The static electricity control additive of the present invention also provides corrosion and scale inhibition in aqueous systems. The additive of the present invention may be employed in combination with other known air-washer additives, such as foam control agents.

The ability of anionic polymeric materials to reduce positive static electricity charges in an air-washer system was evaluated in the following examples.

EXAMPLE I

A water soluble, neutralized, sodium polyacrylate (molecular weight 1,000–5,000) was fed to an air-washer system in a textile manufacturing facility. The air washer system pulls outside air into a chamber having a water trough (sump) and pumps which force the water through water spray heads. The water spray heads discharge 15.6 gallons of water per minute through the spray heads. The water volume (5,000 to 6,000 gallons) of the sump is circulated by intake and output pumps.

The static charge of air entering the chamber was +15 volts per cubic centimeter (v/cc) as measured on an Allen Science Research of Charlotte, N.C. model $HH_3$ hand held static meter. The charge of the air exiting the untreated air washer was +50 v/cc. Four liquid ounces of polyacrylate was added to the sump between the input and output pumps every five minutes. The static charge of the air exiting the system was measured before and after each polyacrylate addition. After three polyacrylate additions, the charge of the exit air achieved the desired −70 v/cc and treatments were halted. The system was monitored and the static charge of the air exiting the air washer remained negative for 12 hours thereafter. Table I summarizes the results.

TABLE I

| Treatment | Feed | Static Charge In | Static Charge Out Pre-Treatment | Static Charge Out Post Treatment |
|---|---|---|---|---|
| polyacrylate | 4 oz at 5 min. | +15 | +50 | −55 |
| polyacrylate | 4 oz at 10 min. | +15 | +30 | −65 |
| polyacrylate | 4 oz at 15 min. | +15 | ±0 | −70 |

EXAMPLE II

The procedure of Example I was repeated with the amount of polyacrylate feed decreased to one fluid ounce every five minutes. Table II summarizes the results.

TABLE II

| Treatment | Feed | Static Charge In | Static Charge Out Pre-Treatment | Static Charge Out Post Treatment |
|---|---|---|---|---|
| polyacrylate | 1 oz. at 5 min. | +20 | +20 | −50 |
| polyacrylate | 1 oz. at 10 min. | +20 | +50 | −100 |

EXAMPLE III

The procedure of Example I was repeated. Table III summarizes the results. Residual charge at 24 hours was −25v/cc.

TABLE III

| Treatment | Feed | Static Charge In | Static Charge Out Pre-Treatment | Static Charge Out Post Treatment |
|---|---|---|---|---|
| polyacrylate | 4 oz. at 5 min. | +15 | +50 | −55 |
| polyacrylate | 4 oz. at 10 min. | +15 | +50 | −65 |
| polyacrylate | 4 oz. at 15 min. | +15 | +45 | −70 |

EXAMPLE IV

Polyacrylate was added to the sump of a 900 ton chiller having a sump system containing 12,000 gallons. The chiller supplies water to the air washer of a textile manufacturing plant. The treatment reduced the static charge of air leaving the air washer from +400–+500 v/cc prior to treatment to +150 v/cc after treatment. The polyacrylate was fed at a rate of 0.67 fluid ounces every 30 minutes by a pump controlled by an electromagnetic timer.

EXAMPLE V

The air washer system of a textile manufacturing plant comprising three air washers with individual chillers fed by a common sump of 60,000 gallons. The static charges of the air washer outlets prior to treatment were +95, +59.3 and +35.2 v/cc respectively. A balanced air washer outlet charge of +35 v/cc was desired. Polyacrylate feed to the individual air washer sumps was controlled by a micro processor which monitored air washer outlet static charge every 30 minutes and dispersed polyacrylate to each chiller as needed to maintain the desired +35 v/cc static charge at the air washer outlets. A feed rate of two ounces of polyacrylate each 30 minutes was found to maintain the air washer outlet static charge between +25 v/cc and +35 v/cc.

The examples show that the addition of neutralized polyacrylates to the water of an air-washer system is effective at reducing the positive static electricity charge of the air treated by the system.

While the present invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A method of reducing a positive static electricity charge of air treated by an airwasher system which comprises adding a static electricity control additive consisting essentially of a water soluble negatively charged, polymeric species to water circulating in said air-washer system.

2. The method of claim 1 wherein said water soluble, negatively charged polymeric species is a sodium polyacrylate having a molecular weight of from about 1,000 to about 5,000.

3. A method of reducing a positive static electricity charge of air treated by an air-washer system which comprises adding a water soluble, negatively charged sodium polyacrylate having a molecular weight of from about 1,000 to about 5,000 to water circulating in said air-washer system.

* * * * *